US008430007B2

(12) United States Patent
Fournier et al.

(10) Patent No.: US 8,430,007 B2
(45) Date of Patent: Apr. 30, 2013

(54) DOCUMENT PROCESSING MACHINE WITH IMPROVED DRIVING SYSTEM

(75) Inventors: Patrick Fournier, Paris (FR); Francois Reby, Nogent sur Marne (FR); Jean-Christian Maleyran, LePerray en Yvelines (FR)

(73) Assignee: Pitney Bowes SAS, LaPlaine St. Denis, Cedex (FR)

( * ) Notice: Subject to any disclaimer, the term of this patent is extended or adjusted under 35 U.S.C. 154(b) by 661 days.

(21) Appl. No.: 12/579,889

(22) Filed: Oct. 15, 2009

(65) Prior Publication Data

US 2010/0095822 A1 Apr. 22, 2010

(30) Foreign Application Priority Data

Oct. 17, 2008 (FR) ..... 08 05752

(51) Int. Cl.
*B26D 7/06* (2006.01)
*B65H 5/00* (2006.01)

(52) U.S. Cl.
USPC ..... 83/446; 83/469; 83/109; 271/34; 271/2; 53/381.3; 53/381.5

(58) Field of Classification Search ..... 83/911, 83/912, 466, 102, 105, 109, 111, 155, 155.1, 83/162, 401, 425, 438, 440, 469, 495, 500, 83/477.2; 30/DIG. 3; 271/1, 2, 34, 35; 53/381.2, 53/381.3, 381.5
See application file for complete search history.

(56) References Cited

U.S. PATENT DOCUMENTS

| | | | | |
|---|---|---|---|---|
| 1,867,973 | A * | 7/1932 | Keiser | 83/176 |
| 2,656,889 | A * | 10/1953 | Kaplan | 83/372 |
| 3,381,564 | A * | 5/1968 | Whiteford | 83/417 |
| 4,973,037 | A * | 11/1990 | Holbrook | 271/2 |
| 5,946,996 | A * | 9/1999 | Oussani et al. | 83/444 |
| 6,912,827 | B2 * | 7/2005 | Forbes | 53/381.3 |
| 7,730,914 | B2 * | 6/2010 | Lin | 144/242.1 |
| 2003/0041561 | A1 | 3/2003 | Forbes | |

FOREIGN PATENT DOCUMENTS

EP 0376519 A2 7/1990

OTHER PUBLICATIONS

European Search Report, Application No. 09172795.8-2304/2177371.

* cited by examiner

*Primary Examiner* — Phong Nguyen
(74) *Attorney, Agent, or Firm* — George M. Macdonald; Charles R. Malandra, Jr.; Steven J. Shapiro

(57) ABSTRACT

An envelope opener is that includes a table for routing documents along a longitudinal document guide wall and a cutting device for cutting off an edge of an envelope is described. The guide wall is movable laterally relative to the cutting device into a plurality of lateral or cutting positions in order to obtain a plurality of cutting widths. The machine also includes a bypass control to enable driving a document in the downstream direction when the cutter device is in the non-cutting position to enable counting envelopes without opening them.

18 Claims, 7 Drawing Sheets

DOCUMENT PROCESSING MACHINE WITH IMPROVED DRIVING SYSTEM

RELATED APPLICATIONS

The present application claims priority of French Patent Application No. 0805752, filed Oct. 17, 2008, that is hereby incorporated by reference in its entirety.

BACKGROUND

The illustrative embodiments of the present application relate generally to document processing machines and more specifically to new and useful envelope openers. Machines are known for processing documents such as envelopes in which a portion of the documents is cut off. Machines in which the documents are envelopes are commonly known as envelope-openers.

SUMMARY

The Applicant has realized among other things that it could be useful to be able to feed a document in such envelope opening machines without cutting it. For example, it could be useful to pass the documents over the feed table in order to count them using counting means such as a photo-electric cell, without cutting them.

To feed a document over the table without cutting it, the Applicant has described several illustrative embodiments of such envelope openers including those configured for moving the guide wall 18 into an extreme lateral position (non-cutting position).

Other features and advantages will become apparent in the course of the following description, given by way of nonlimiting example only and with reference to the appended drawings.

BRIEF DESCRIPTION OF THE DRAWINGS

The accompanying drawings, which are incorporated in and constitute a part of the specification, illustrate embodiments of the application, and together with the description given above and the detailed description of the embodiments given below, serve to explain the principles of the invention. As shown throughout the drawings, like reference numerals designate like or corresponding parts.

DETAILED DESCRIPTION

Figure 1:
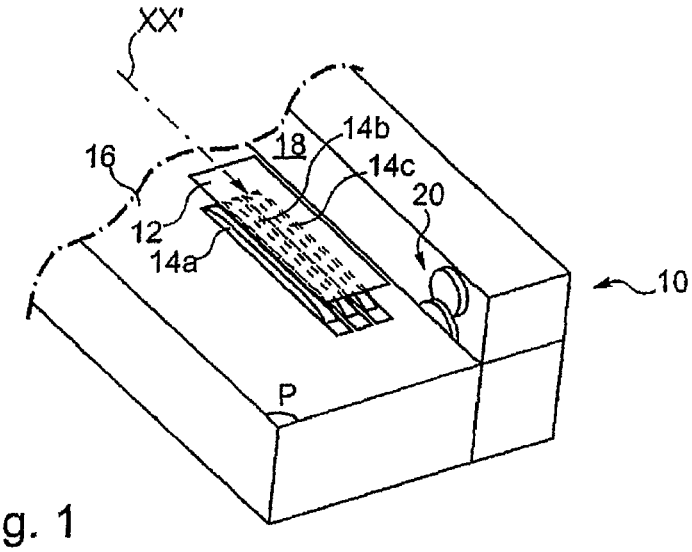
FIG. 1 is a diagrammatic perspective view of a document processing machine according to an illustrative embodiment of the present application.

While the illustrative embodiments of the present application have been disclosed and described with reference to an illustrative envelope opener device, it will be apparent, as noted above that variations and modifications may be made therein. It is, thus, intended in the following claims to cover each variation and modification that falls within the true spirit and scope of the present invention.

Machines are known for processing documents such as envelopes in which a portion of the documents is cut off. Machines in which the documents are envelopes are commonly known as envelope-openers. Applicants have developed a new and improved such machine 10 shown diagrammatically in FIG. 1, the envelopes 12 are driven one by one, for example by belts 14*a*, 14*b*, 14*c*, in a movement of longitudinal displacement along the axis XX' on the surface of a horizontal table 16 forming a support. The envelopes are guided along a longitudinal wall 18 disposed on one side of the table 16. A device 20 for cutting off a portion of the envelopes, in particular one of the edges thereof, is disposed along the table, aligned with the guide wall 18, to be in contact with the portion of each envelope to be cut off.

Figure 2:
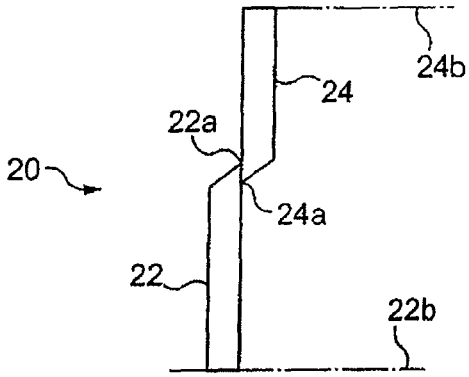
FIG. 2 is a diagrammatic view in cross section of a cutter device shown on the machine of FIG. 1.

The cutter device 20 is shown diagrammatically in cross section in FIG. 2. It comprises a lower cutter 22 and an upper cutter 24 which have cutting edges 22*a*, 24*a* arranged adjacent to each other. The cutters are mounted to rotate about respective horizontal axes 22*b*, 24*b* perpendicular to the longitudinal direction XX' of movement of the envelopes.

Figure 3:
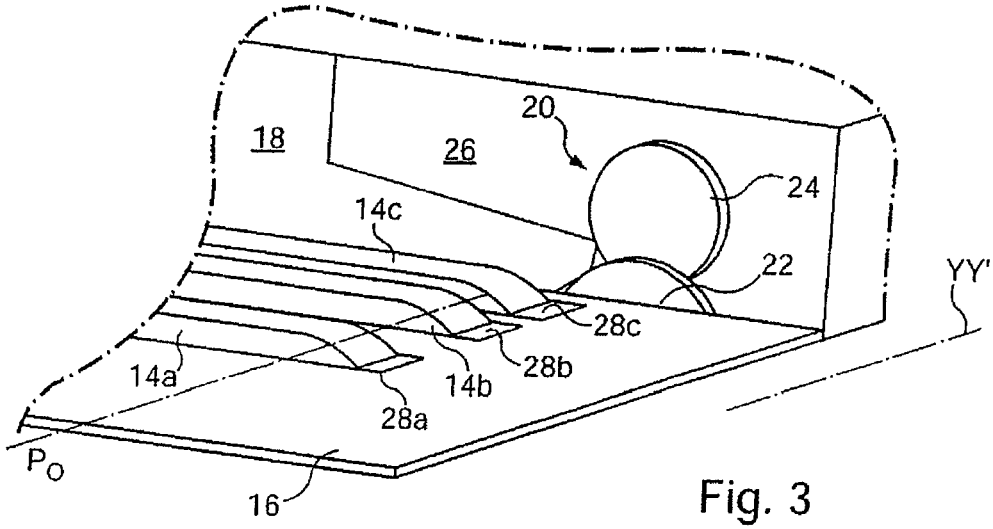
FIG. 3 is a diagrammatic perspective view to a larger scale of the portion of the machine of FIG. 1 showing an illustrative guide wall, cutter device and conveyor belts of the table 16.

FIG. 3 shows diagrammatically in perspective the arrangement of the guide wall 18 and the cutter device 20 on one of the longitudinal sides of the table 16 and the belts 14*a*-14*c*. The belts project above the table 16 through respective apertures 28*a-c* formed in the thickness of the table. The cutter device is disposed in a fixed wall 26 fastened to the frame of the machine. The guide wall 18 placed at the upstream end of the cutter device is adapted to be moved laterally along the transverse axis YY' to position the document to be cut between the cutters 22 and 24, in a number of possible cutting positions. Thus various widths can be cut off the document according to the position of the wall.

The belts 14*a-c* route the document of which a portion is to be cut off on the table 16 and along the wall 18 to the cutter device. As soon as the document is engaged between the cutters 22 and 24 and cutting begins the document is then driven in the downstream direction by the cutter device, not by the belts 14*a-c*. For this reason, the belts descend below the table 16 at a location thereof corresponding to a longitudinal position along the axis XX' represented by the reference Po. This position Po is upstream of the longitudinal position at which the document is engaged between the cutters. Thus, in order to avoid interfering with the cutting operation, the belts are arranged so that they do not continue to drive a document that is already engaged in the cutter device.

The Applicant has realized that it could be useful to be able to feed a document in such machines without cutting it. For example, it could be useful to pass the documents over the feed table in order to count them using counting means such as a photo-electric cell, without cutting them. To feed a document over the table without cutting it, the Applicant has made provision for moving the guide wall 18 into an extreme lateral position (non-cutting position). In this position the wall is offset laterally in the direction of the table 16 so that the cutter device is no longer aligned with the wall when moved in this way. However, the belts 14*a-c* can no longer route documents downstream of the position Po in FIG. 3. Moreover, when the wall is arranged in this fashion, the cutter device, which at this point used to take over to drive the documents to be cut in the downstream direction, is bypassed and can no longer act on the documents.

The Applicant has nevertheless provided at least one drive member that is mobile between a rest position and a driving position, in which latter position it drives a document in the downstream direction when the guide wall has simultaneously been moved to the non-cutting position and the conventional driving means (for example belts) are ineffective. Thus one particular nonlimiting object of at least one illustrative embodiment of the present application is to provide a document processing machine including a table for routing documents in a longitudinal direction, a longitudinal document guide wall disposed on one side of the table, and a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position.

Thus said at least one drive member is adapted to be placed in its driving position when the wall is in a non-cutting position in order to drive in the downstream direction documents routed by the table and not cut.

According to one illustrative feature, the machine includes a mechanism for moving the longitudinal wall that is connected to a mechanism for moving said at least one drive member. This arrangement ensures that the two movements, that of the wall and that of said at least one drive member, are linked and therefore that the one cannot take place without the other.

According to another illustrative feature, the machine includes a single drive system for simultaneously driving the movement of the wall and the movement of said at least one drive member, which is particularly convenient and simple for the user. However, independent driving systems can be envisaged instead, driving each of the movements independently, according to what is required, the arrangement of the machine and the applications.

According to another illustrative feature, the machine includes a drive shaft connected to the wall and that is adapted to be driven in rotation about its shaft, the shaft being provided with a contact member that cooperates with a cam fastened to the wall during movement in rotation of the shaft in order to move the wall. This particularly simple mechanism moves the document guide wall to the extreme lateral position of that wall referred to as the non-cutting position. To be more specific, the contact member is at one end of the shaft and said shaft has at its opposite end a toothed pulley for driving the shaft in rotation.

According to another illustrative feature, said at least one drive member is adapted to effect a pivoting movement between a retracted rest position and a deployed driving position. Thus said at least one drive member is set back from the path followed by the documents, in a rest position that is, for example below the level of the document routing table. It is extracted from that position to occupy a deployed driving position, for example above the routing table, in order to drive in the downstream direction a document that will not be processed by the cutter device.

According to another illustrative feature, said at least one drive member is mounted to pivot about a first reference shaft, the pivoting being driven by the movement of a drive shaft connected to said at least one drive member and which extends relative thereto parallel to the first reference shaft. The pivoting movement of said at least one drive member is controlled in a simple manner by this drive shaft connected to said at least one member.

According to another illustrative feature, said at least one drive member is connected to the first reference shaft by a connecting part pivotally mounted on said first reference shaft, the drive shaft being attached to the connecting part.

According to another illustrative feature, the drive shaft cooperates with a mobile cam movement whereof drives movement of said drive shaft. Actuation of this cam thus provides an easy way to drive the pivoting of said at least one drive member. To be more specific, the cam is mounted to rotate about a second reference shaft attached to the machine.

According to another illustrative feature, the cam has two opposite faces, a first or internal face provided with a cam surface for cooperation with the drive shaft of said at least one drive member and an opposite second or external face that is provided with a drive member for driving movement of the cam.

According to another illustrative feature, the cam carries a manual control knob for moving it. This knob serves as a drive member and is easily accessible to the user because it is situated on the external face of the cam facing away from the machine.

According to another illustrative feature, the cam is provided with a toothed pulley for driving its movement. This pulley serves as an intermediate drive member used in cooperation with another intermediate drive member forming part of the mechanism for moving the longitudinal wall. Thus actuation of the cam simultaneously moves the drive shaft and drives the movement of the wall.

According to another illustrative feature, an elongate connecting member, for example a ribbed belt, runs around the two toothed pulleys, that of the mechanism for moving said at least one drive member and that of the mechanism for moving the longitudinal wall, in order to link the rotation movements of the two pulleys to each other. This connection therefore links together the movements of two mechanisms for moving the wall and said at least one drive member via their respective intermediate drive members. Thus driving rotation of one of the two pulleys ensures rotation of the other pulley and therefore actuation of the associated two mechanisms.

According to another illustrative feature, said at least one drive member is driven in rotation on itself by drive means. These drive means are partly mounted on the first reference shaft.

According to another illustrative feature, these drive means are in part mounted on the connecting part connected to said at least one drive member and pivotally mounted on the first reference shaft. For example, these rotation drive means take the form of an intermediate gear meshing with a gear attached to the first reference shaft and a gear associated with said at least one pivot member.

According to another illustrative feature, elastic means are coupled to said at least one mobile drive member so that, in the driving position of the latter member, said spring means exert an elastic force tending to hold said at least one drive member in that position. For example, the elastic means comprise a return spring which, through the force that it exerts on said at least one drive member in its driving position, exerts pressure on the document that will be in contact with said at least one drive member.

According to another illustrative feature, an additional drive member is arranged in a fixed position above said at least one mobile drive member and is adapted to cooperate therewith to pinch a document between said mobile and fixed drive members when said at least one drive member is in its driving position. This additional drive member takes the form of a counter-roller, for example.

According to another illustrative feature, the document routing table includes document routing means adapted to route documents toward the downstream end of the machine along the longitudinal wall when the wall is in a cutting position, said at least one driving member then being in its rest position. Thus when the cutter device is active, the conventional means for routing documents along the wall convey them to the cutter device without said at least one drive member intervening. Said at least one drive member is actuated when the cutter device is de-activated by the extreme lateral displacement of the longitudinal wall in the non-cutting position.

The document processing machine of the invention includes the components already described with reference to FIGS. 1 to 3 and their description will therefore not be repeated here. The references of these components therefore remain the same, and only new components are now described and carry new references.

Figure 4:
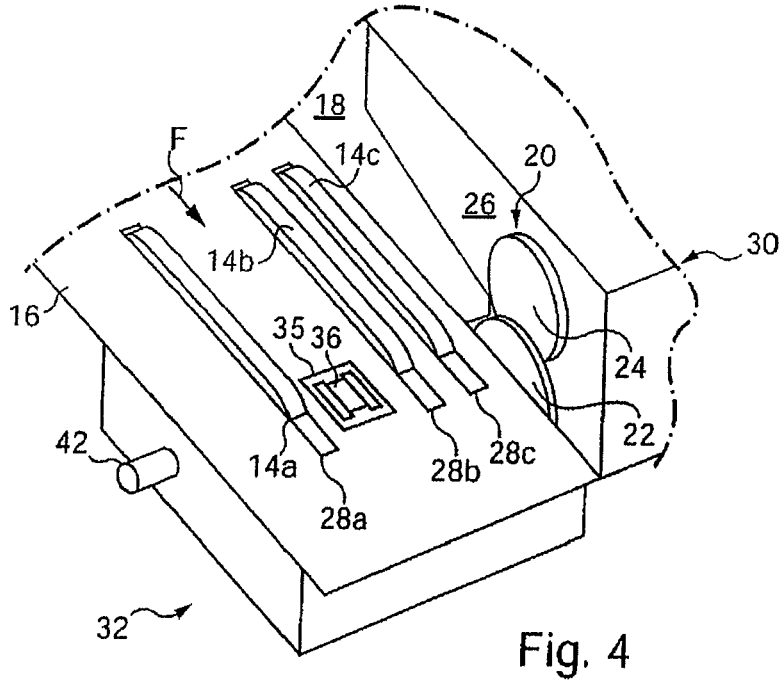
FIG. 4 is a diagrammatic perspective view from above of the document processing machine according to an illustrative embodiment of the present application.

As shown diagrammatically in FIG. 4, the machine 30 includes under the document routing table 16 a system 32 that drives the documents routed on the table when the cutter device 20 is de-activated, following appropriate lateral movement of the wall 18 that guides the documents. A window 35 is formed through the thickness of the table 16 to enable deployment above or retraction below the table, on command, of one or more document drive members to be activated or de-activated as a function of the lateral position of the wall 18.

Generally speaking, the window 35 is positioned at a lateral distance from the wall 18 that is sufficient for the drive member protruding from this window to be in contact with documents (e.g. envelopes) of varied widths when the wall is in the non-cutting position. This window 35 is disposed between two apertures through which the document transport belts pass. For example, the window 35 is placed between the two apertures at the greatest distance from the guide wall 18, namely the apertures 28*a* and 28*b*. Note that in FIGS. 15 and 16, the window 35 is shown adjacent the opening 28*b* because of the somewhat more severe constraints in terms of overall size. This kind of arrangement is not obligatory.

Figure 5:
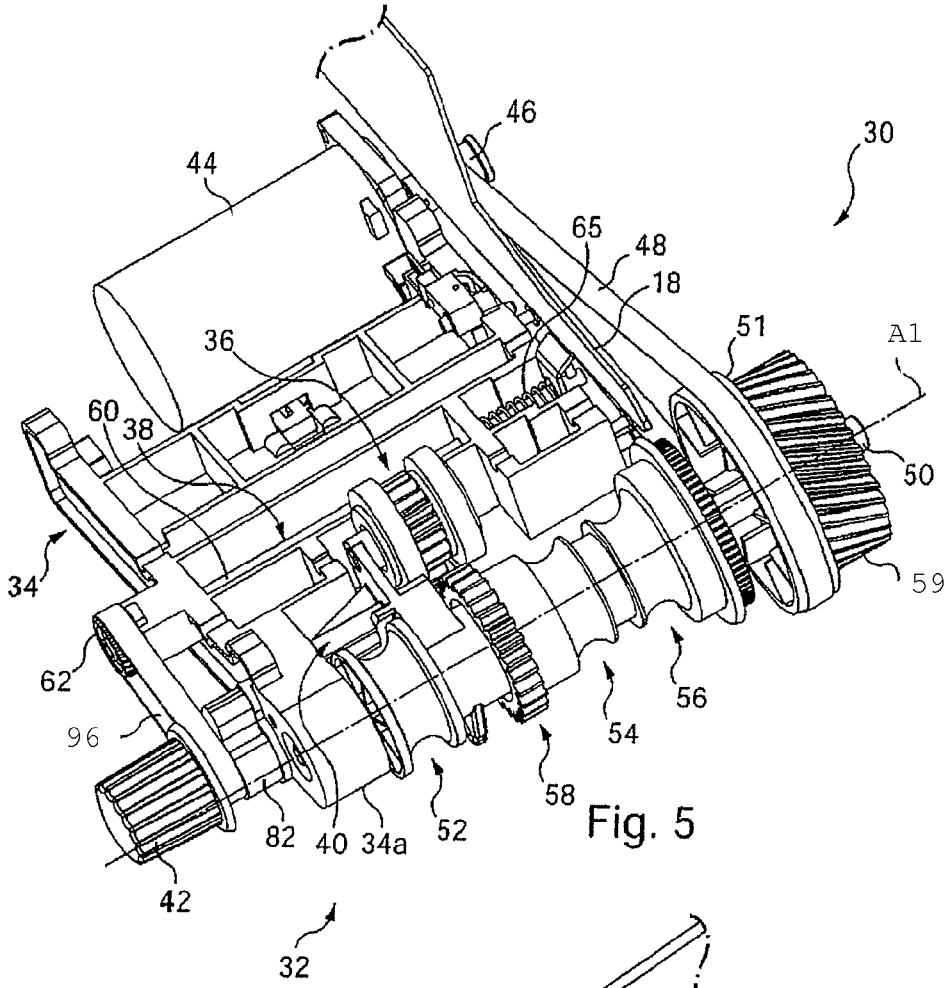
FIG. 5 is a diagrammatic view from above of the machine of FIG. 4 without the table and the drive belts.

FIG. 5 is a diagrammatic view of the FIG. 4 system 32 after removing the table 16, the belts 14*a* to 14*c*, and the pulleys on which they are mounted. The system 32 includes a plate 34 fixed to the frame 30 of the machine. The system 32 further includes a number of mechanisms attached to the plate, one of which drives movement of one or more document drive members and the other of which drives movement of the guide wall 18. In the illustrative embodiment described here, only one drive member 36 is shown. The principle nevertheless remains the same if a number of drive members is provided. For example, it suffices for this to arrange a number of drive members on the same shaft, which shaft can then be driven in the same way as for a single drive member. Other arrangements are equally possible, without departing from the scope of the present invention, for example with a number of shafts for mounting the various members.

The machine more particularly includes a mechanism 38 for moving the wall 18 described with reference to FIGS. 6 and 7. The machine also includes a mechanism 40 for moving the drive member 36. These two mechanisms are linked (see below). Linked in this way, these mechanisms can be operated by a single control which is represented here by a manual control member such as a knob 42 (FIG. 5). At least one advantage of a single control member is that it simplifies simultaneous use of the two mechanisms.

Note, however, that other embodiments are possible in which the two mechanisms 38 and 40 are mechanically independent of each other, for example, and a suitable drive system for each of these mechanisms is necessary to operate each of them. Note also that each of the mechanisms 38 and 40 can be actuated independently, for example, by an appropriate mechanical control member, adapted to each of the mechanisms. For example, each of these members can be controlled electronically using document detector means. For example, document detector means such as a photo-electric cell that detects the passage of a document in front of it, send a pulse to an electronic control system which then actuates each of the aforementioned mechanisms. This photo-electric cell can advantageously also be used to count the documents by means of an appropriate processor electronic circuit downstream.

Figure 15:
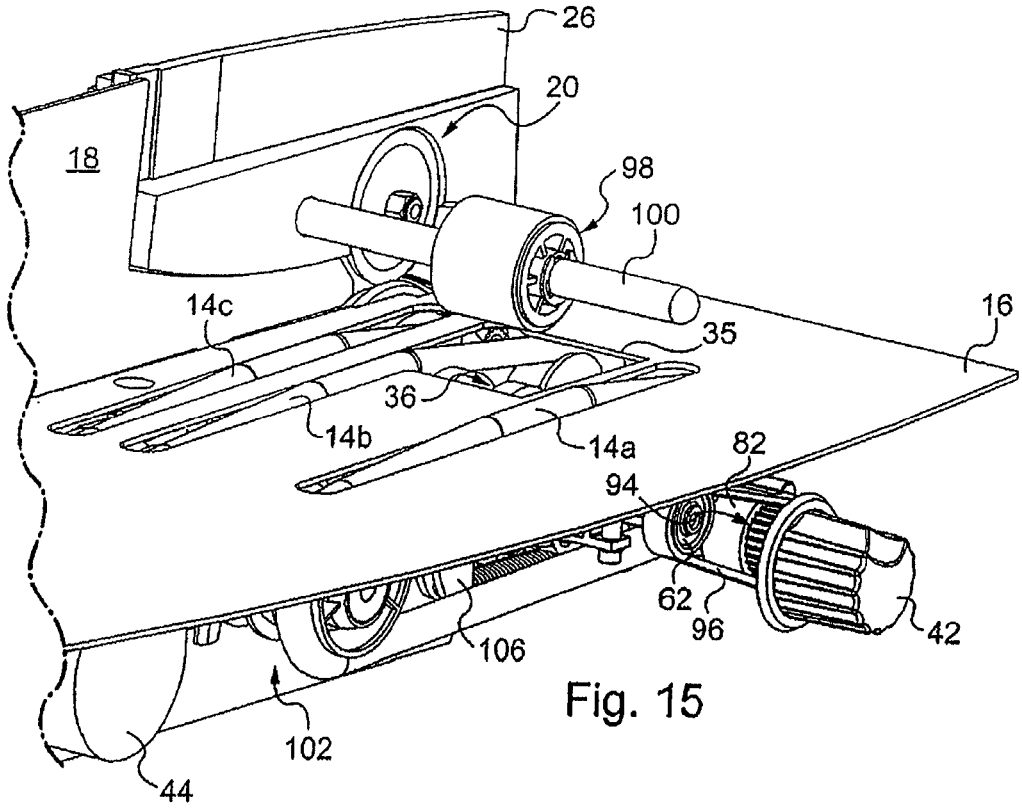
FIG. 15 is a diagrammatic partial perspective view showing the drive member in its retracted position.
Figure 16:
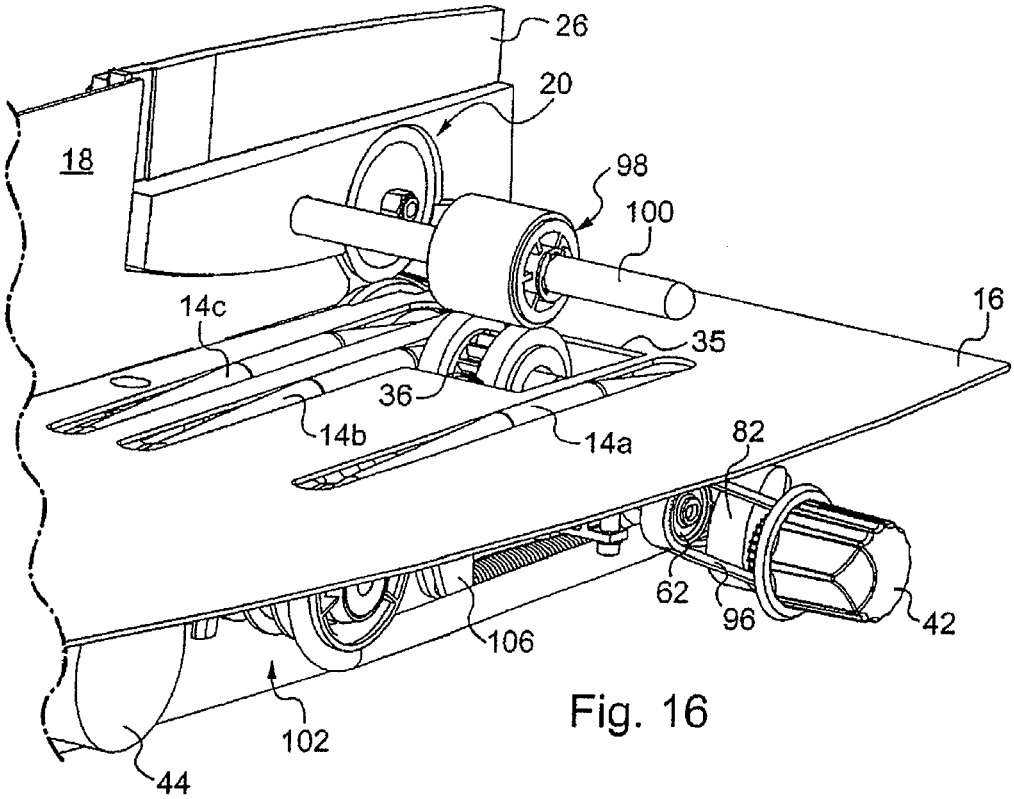
FIG. 16 is a diagrammatic partial perspective view showing the drive member in its extraction position.

As shown in FIG. 5, a motor 44 is arranged alongside the plate 34. It is also fixed to the frame of the machine and has an output shaft 46. A drive belt 48 wraps, on the one hand, around the output shaft 46 of the motor and, on the other hand, around another shaft 50, thus communicating a rotation movement to that shaft. Note that the belt 48 is mounted on the shafts 46 and 50 by means of respective pulleys. The driven shaft 50 is aligned with a first reference shaft A1 and a number of members are mounted to rotate about this reference shaft A1, including the pulley 51 around which the belt 48 wraps. Thus there are pivotally mounted about the shaft A1 three receiver pulleys 52, 54, 56 the grooves whereof can be seen in FIG. 5 and on which are mounted respective belts 14*a*, 14*b* and 14*c*. Other similar pulleys such as the pulley 102 in FIGS. 15 and 16 are arranged on the other side of the plate but are not shown in this figure for reasons of clarity.

The drive means that have just been described drive movement of the document routing belts and therefore the documents themselves. Note that the first reference shaft also carries a toothed ring 58 that forms part of the drive means for the drive member 36 (see below). This ring in fact drives the member 36 in rotation on itself to drive the documents. The first shaft A1 also carries a toothed gear 59 fastened to the pulley 51 and meshing with a gear 57 (FIG. 12) carried by the shaft on which the upper cutter 24 is mounted in order to drive the latter in rotation. The aforementioned document routing means route the documents toward the downstream end of the machine in the direction indicated by the arrow F in FIG. 4 when the longitudinal wall 18 is in a cutting position 18(C) shown in dotted line in FIG. 7.

Figure 6:
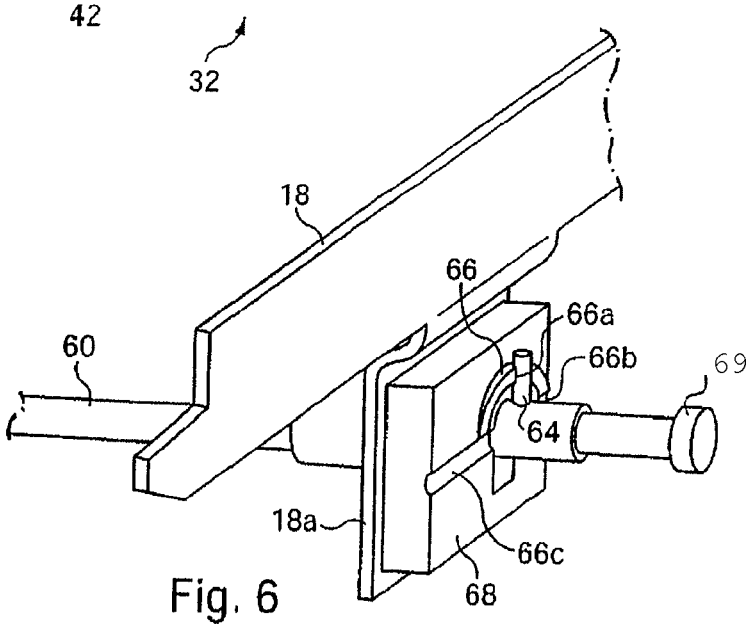
FIG. 6 is a partial diagrammatic perspective view to a larger scale of the mechanism for moving the wall according to an illustrative embodiment of the present application.
Figure 7:
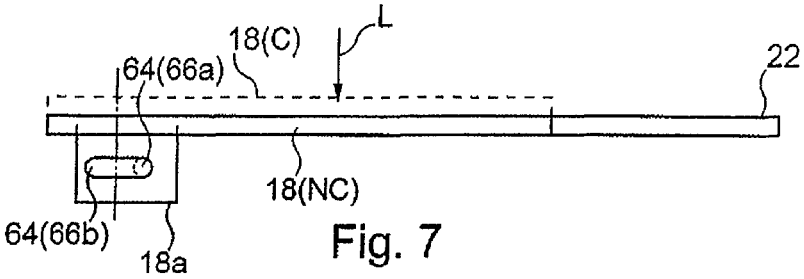
FIG. 7 a partial diagrammatic view from above illustrating the lateral movement of the wall shown in FIG. 6.

FIG. 7 also shows the lower cutter 22 of the cutter device, the wall 18 in this position driving a document until it comes into contact with this cutter for the cutting operation. As shown in FIG. 5, the mechanism 38 for moving the wall 18 includes a drive shaft 60 that is connected to the wall 18, for example at one of its longitudinal ends. This shaft can be driven in rotation about its shaft as indicated by the arrow in FIG. 6. For driving it, the shaft 60 is provided at its opposite longitudinal end with a toothed pulley 62 that can be seen in FIGS. 5 and 12.

FIG. 6 shows diagrammatically the connection between the drive shaft 60 and the wall 18. Generally speaking, the shaft 60 is provided with an actuator member 64 that cooperates with a cam 66 attached to the wall. This cam has on its surface a number of intermediate stop positions, of which two positions 66*a* and 66*b* are shown in FIG. 6. Following rotation movement of the drive shaft as indicated by the arrow, the actuator member 64, which takes the form of an actuator finger, for example, moves over the surface of the cam 66 and takes up a position in one of the recesses thereof, for example the recess 66*a* in FIG. 6.

This stop position corresponds, for example, to a cutting position of the wall such as the position 18(C) shown in FIG. 7. As the rotation movement continues, this actuator member continues its movement in contact with the surface of the cam 66 and then takes up a position in the next recess 66*b*, thus moving the wall into an extreme lateral or non-cutting position 18(NC) shown in FIG. 7. The lateral movement of the wall between the two stop positions 66*a* and 66*b* is shown by the arrow L in FIG. 7. With this arrangement, the wall 18 is offset relative to its position 18(C) and a document routed along this wall then passes in front of the lower cutter 22 instead of passing over it, thus avoiding the cutting operation.

FIG. 6 shows more specifically the presence in the lower portion of the wall 18 of an offset edge 18*a* that forms a lateral step relative thereto, to which a plate 68 fitted with the cam 66 is fixed. This cam takes the form of a wall extending from one of its ends from the large free face of the plate 68 and progressively moving away from the latter along the start of a spiral trajectory. Note that another stop position 66*c* of the actuator member 64 is provided on the free face of the plate 68 in order to receive this member there during rotation of the drive shaft 60 in the direction opposite the arrow shown in FIG. 6. This position 66*c* corresponds to a cutting position of the wall 18 different from that shown in FIG. 7, producing a different document cutting width.

Figure 12:
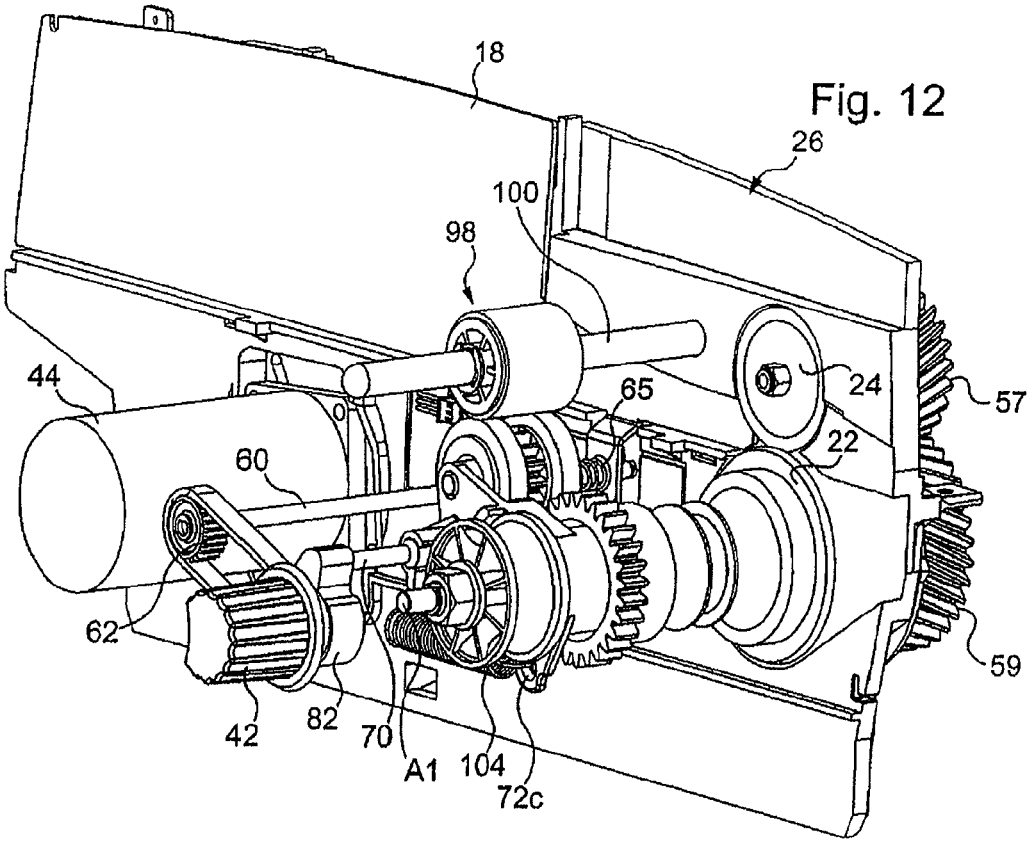
FIG. 12 is a partial diagrammatic perspective view of the mechanisms situated under the table with the plate removed for clarity.

FIG. 7 shows diagrammatically the offset edge 18*a* forming a step and in dashed line a first position of the actuator member 64 when it is located in the recess 66*a* and a second position of this member when it occupies the next recess 66*b*, these two positions being situated at 90° to each other. Note that a spring 65 is placed between, on the one hand, the free face of the offset edge 18*a* opposite that on which the plate 68 is disposed and, on the other hand, a portion of the plate facing said free face (FIGS. 5 and 12). This spring maintains permanent contact between the member 64 and one of the recesses 66*a-c*. Note that a part 69 (for example a screw) serves as a stop for the lateral movement of the wall 18, thus defining the maximum cutting width.

The mechanism 40 for moving the drive member 36 is described next with reference to FIG. 8 and the subsequent figures. This member is mounted in the machine 30 so that it can pivot about the first reference shaft A1 between a retracted or rest position shown in FIGS. 4 and 15 and a deployed active or driving position shown in FIG. 16. The pivoting movement of the member 36 about the pivot shaft A1 is driven by controlling the movement of a drive shaft 70 shown in FIGS. 8 to 11. This shaft is parallel to the first reference shaft A1 and extends outward relative to the drive member 36.

Figure 8:
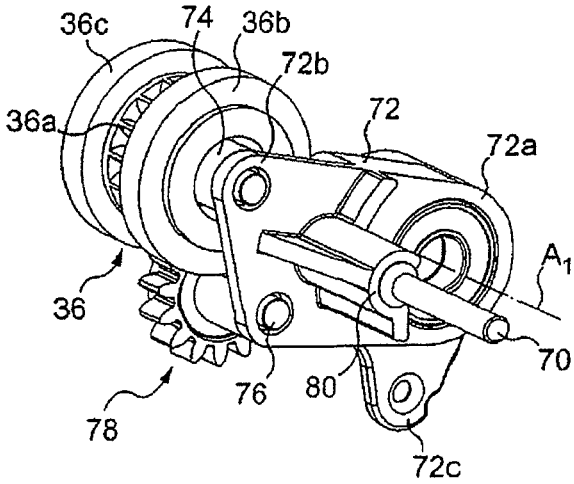
FIGS. 8 and 9 are diagrammatic perspective views of the drive member 36 and its connecting part 72 as shown respectively from two different angles.
Figure 9:
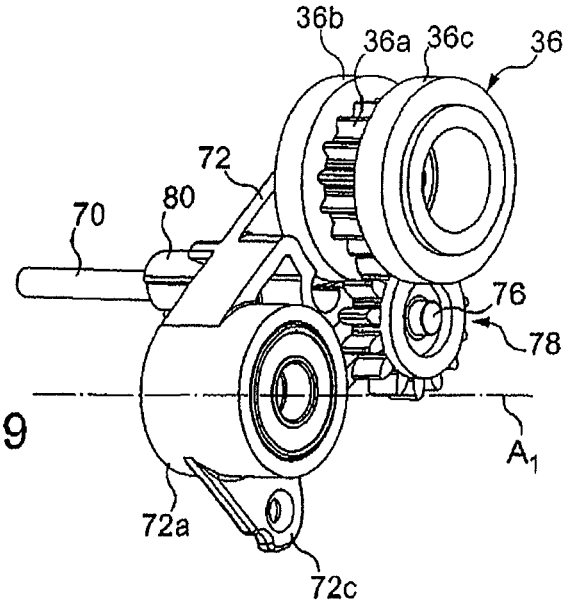

More specifically, as shown in FIGS. 8 and 9, the drive member 36 is mounted on a connecting part 72 whose general shape is that of a plate or base provided with a number of holes for receiving various shafts. Thus this plate has a first end 72*a* of increased thickness through which a hole is formed to receive the first reference shaft A1 on which the part 72 pivots. This part has at its opposite end 72*b*, in a plane portion of the plate, a hole through the smaller thickness thereof and in which is mounted a shaft 74 for mounting the drive member 36 and on which it pivots about this shaft. The shaft 74 is disposed in the upper portion of the opposite end 72*b* of the connecting part, while another shaft 76, disposed in the lower portion of the plate, is provided for mounting an intermediate drive member 78 referred to again later in the description of the movement of the drive member 36. Furthermore, the plate 72 forming the base has on its face opposite that from which the shafts 74 and 76 extend a hub 80 extending toward the exterior of the part 72 and in which the drive shaft 70 previously referred to is mounted.

Note that the substantially cylindrical hub 80 is partially open along a generatrix in order to provide a free space for another part to pass through, here the rotary part 52 (FIG. 5). Also note that all the shafts that have just been described are parallel to each other all perpendicular to the plane containing the general direction in which the connecting part 72 extends. The parallel relationship of all of these shafts, which receive either pulleys or gears, ensures good mechanical operation of the system.

As shown in FIGS. 8 and 9, the connecting part 72 also includes in the lower portion a protruberance 72*c* through which passes an orifice parallel to the orifices described above for receiving the various shafts. This orifice is intended to receive one of the ends of an elastic hub to couple the latter to the drive member 36. At least some of the utility of these elastic means is described below. The drive shaft 70 enters a portion 34*a* of the plate on the front face thereof, opposite the rear face of the plate facing the wall 18 (FIG. 5).

Figure 10:
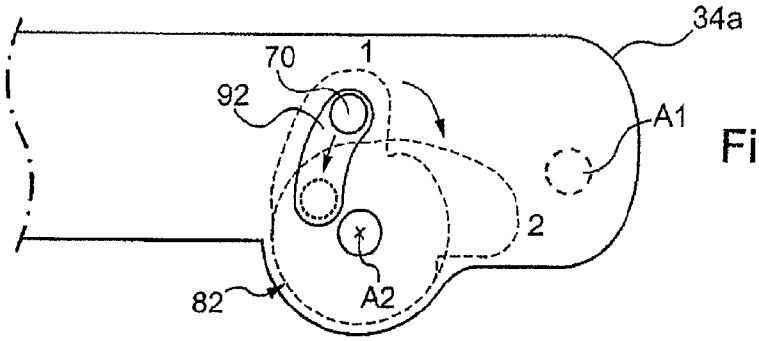
FIG. 10 is a diagram illustrating the pivoting movement of the cam 82 in a front view of the plate 34.

FIG. 10 shows in front view the portion 34*a* of the plate on which are shown the drive shaft 70 and, in dashed line, the first reference shaft A1 located to the rear of the portion 34*a*. This shaft 70 cooperates with a mobile cam 82 in the manner shown in FIGS. 5, 10, 11 and 12. The cam 82 is shown on its own in FIGS. 13 and 14, which show its opposite internal and external faces. The cam has the general shape of the digit 6, for example (see FIGS. 13 and 14), but other shapes can be envisaged, of course, without departing from the scope of the present invention, to provide the same functions as the cam shown in the figures. The main function of the mobile cam 82, whatever its shape, is to co-operate with the drive shaft 70 so that the movement of said cam drives movement of the drive shaft and therefore pivoting of the drive member 36.

Figure 11:
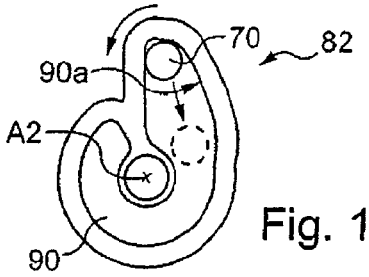
FIG. 11 is a diagrammatic view showing the inside face of the cam 82 and its cooperation with the shaft 70.
Figure 13:
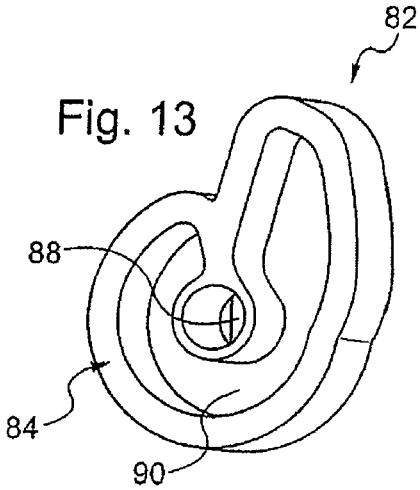
FIGS. 13 and 14 are diagrammatic perspective views of the internal face and the external face, respectively, of the cam 82.
Figure 14:
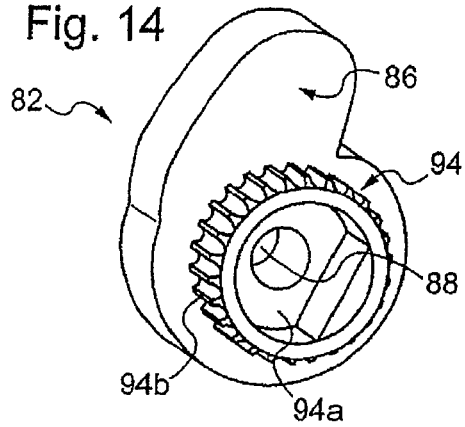

As shown in FIGS. 13 and 14, the cam 82 has an internal face 84 (FIG. 13) and an external face 86 (FIG. 14). The internal face is intended to face toward the drive shaft 70, more particularly to face the front face of the plate (FIG. 10), while the opposite external face 86 is intended to face away from the plate, facing toward the user of the machine (FIGS. 5 and 12). The internal face includes a recess 90 having the general shape of a reversed 6 shape (FIG. 13), with a hole 88 through its center. A second fixed reference shaft A2 is housed within the thickness of the front portion 34*a* of the plate and one end of this shaft projects relative to the plate and is accommodated in the hole 88 through the cam, thus enabling the latter cam to be mounted to rotate about this second reference shaft (FIGS. 10 and 11). The rotation movement of the cam is shown in FIG. 10, which shows two extreme pivoted positions 1 and 2 of the cam.

FIG. 11 shows diagrammatically the internal face of the cam in contact with the front portion 34*a* and, like FIG. 13, shows the recess 90 centered around the hole 88 for receiving the shaft A2. The drive shaft 70 is arranged perpendicularly to the internal and external faces of the cam and is engaged in the aperture 90 on its internal face, in the upper portion of the 6-shape, as shown in FIG. 11, when the general 6-shape is substantially vertically positioned. The cam is shown in dashed line in FIG. 10 in order not to conceal the elements situated behind it and in a position that is the reverse of that of FIG. 11. Thus the cam 82 is shown in position 1 with the drive shaft situated at the top.

The front face of the plate 34*a* also has an aperture 92 through it, through which the drive shaft 70 passes in order to come into contact with the cam 82. When a pivoting movement in the direction indicated by the arrow in FIG. 10 is imparted to the cam 82 (to pivot the cam from the position 1 to the position 2 in which the cam is substantially on its side), the drive shaft 70 is moved in the direction indicated by the downward arrow, being guided laterally by the facing opposite walls of the aperture 92 in the plate. During this pivoting movement, the end of the drive shaft that is received in the internal housing 90 of the cam follows the cam profile of the internal wall 90*a* of that housing. This cam profile corresponds more particularly to the portion of the internal wall defining the exterior surface of the general shape of the digit 6 (FIG. 11).

Turning the cam in the direction indicated by the arrows in FIGS. 10 and 11 therefore causes the movement of the drive shaft shown in these figures. The shaft 70 therefore traces out a portion of a circular trajectory centered on the first reference shaft A1 (FIG. 10). This drives pivoting of the drive member 36. As already mentioned, the cam 82 has an external face 86 that is not hollow like the internal face 84 but smooth over most of its surface. For example, this external face includes, centered on the through-hole 88, a member 94 that extends an axial distance perpendicular to this face less than the thickness of the cam 82 (the distance between its internal face 84 and its external face 86). This member 94 that projects relative to the external face 86 serves as a drive member for moving the cam. To this end it has a recessed central portion 94*a* which has a circular general shape truncated on one side to form a flat. The shape of this internal housing enables it to receive, mortice-and-tenon nesting fashion, a male portion of complementary shape that is part of an external part.

Note that the reference shaft A2 passes through the hole 88 in the cam and extends axially beyond the drive member 94. As shown in FIGS. 4, 5 and 12, the control knob 42 includes, in a manner that is not shown in those figures, a central hub recessed at its center to receive the projecting end of the reference shaft A2. This hub has at its outside periphery a shape complementary to that of the housing 94*a* of the drive member 94. Also mounting the control knob on the shaft A2 ensures that the cam 82 and the knob 42 have a common centering reference. This facilitates the production of the connection between the cam and the knob in that the tolerances for these parts do not need to be very tight.

The nesting of the hub of the control knob 42 with the cavity 94*a* of complementary shape thus fastens together in rotation the two parts 42 and 82 so that rotation of the cam can be driven by simple manual pivoting of the control knob.

Thus rotation of the control knob 82 by a user (for example in the clockwise direction) pivots the cam which moves the drive shaft 70 as indicated by the arrows in FIGS. 10 and 11. This movement shifts the control member 36 to its bottom or rest position. Opposite rotation of the control knob moves the cam 82 from position 2 in FIG. 10 to position 1, the effect of which is to raise the drive shaft 70 and therefore to move the drive member 36 from its rest position to its extraction or drive position.

As shown in FIG. 14, the drive member 94 has on its exterior face teeth 94*b* conferring on said member the shape of a toothed pulley. This member has a two-fold function, namely a first function of cooperating with an external control member such as the manual control knob 42 to drive rotation of the cam and a second function of linking the rotation movement of the cam to the rotation movement of a drive member of the mechanism 38 for moving the wall 18. To this end, an elongate connecting member 96 wraps around, on the one hand, the toothed pulley 62 of the mechanism 38 and, on the other hand, the toothed pulley 94*b* of the mechanism 40, in order to interlink the rotation movements of these two members. For example, this kind of connecting member takes the form of a belt with teeth on its internal face adapted to cooperate with the external teeth of the two pulleys. Thus a user finds it easy to operate the two mechanisms simply by rotating the control knob 42.

The drive member 36 shown in FIGS. 5, 8 and 9 takes the form of a drive roller, for example, including a central gear 36*a* mounted on the shaft 74 between two smooth wheels 36*b*, 36*c*, for example elastomer wheels of greater diameter than the central gear so that they are able to come into contact with the documents to be transported. As shown in FIGS. 12, 15 and 16, an additional drive member 98 is arranged at a fixed position above the drive member 36. This member or counter-roller 98 is mounted to rotate freely about a shaft 100 formed in the fixed wall 26 (FIG. 12).

FIG. 15 is a partially diagrammatic view in perspective showing the drive member or roller 36 in its rest (retracted) position under the table 16 or substantially flush with the latter via the window 35. This figure shows one of the belts 14*a* mounted on a receiver pulley 102 identical to the pulleys 52, 54 and 56 from FIG. 5 but positioned at the opposite end of the plate. In FIG. 15, the manual control knob has been turned by the operator so that the cam is substantially on its side position (position 2 in FIG. 10) and so that the drive shaft is therefore in the low position in order for the drive member 36 itself also to be in the low (retracted) position.

When the machine is in this configuration, the longitudinal wall 18 is in one of its cutting positions and routes documents (envelopes) to be cut to the cutter device 20 aligned with it by means of the conveyor belts 14*a-c*. On the other hand, to bypass the cutter device 20, the user turns the manual control knob 42 to pivot the cam 82 to the top position (position 1 in FIG. 10). This rotation movement shifts the drive shaft 70 from the position shown in dashed line in FIG. 10 to the position shown in solid line in the same figure. Thus the drive member 36 pivots about the shaft A1 and is raised to project through the window 35 to adopt the FIG. 16 ejection or driving position.

This rotation movement is also transmitted to the toothed pulley 62 of the mechanism 38 for moving the wall via the belt 96, which as described above causes lateral displacement L of the wall (FIG. 7) to bring it to the non-cutting position. The documents are therefore diverted from their path that would normally have fed them to the cutter device. The documents such as envelopes are therefore routed by conventional drive means of the machine (for example belts 14*a-c*) as far as the window 35, where they are then taken up by the drive member 36 cooperating with the additional drive member 98 and are accelerated. In this connection note that the documents are pinched between the two drive members 36 and 98 and are driven toward the downstream end of the machine by the driving in rotation of the member 36.

To this end, the reference shaft 81 is driven in rotation by the motor 44 as mentioned above and the gear 58 is therefore driven in rotation by the shaft, in turn driving the intermediate member 78 in rotation in the opposite direction. The latter member then transmits movement in rotation in the opposite direction to the central gear 36*a* of the drive member, which is therefore caused to turn in the same direction as the reference shaft A1 thanks to the presence of the intermediate gear 78.

As mentioned above, the machine also includes elastic means 104 shown in FIG. 16 in the form of a return spring that is fixed at one end to the projecting lower portion 72*c* of the connecting part (FIG. 8) and at its opposite end to a fixed element 106 of the plate below it. The coupling of these spring means with the drive member 36, when the latter member is deployed (FIG. 16), exerts additional pressure on the document pinched between the two members 36 and 98. This elastic force is obtained when the elastic means are compressed. Coupling the drive member with elastic means working in tension rather than in compression could instead be envisaged.

When the documents have been routed in this way by the machine newly configured in accordance with the invention, the machine can be used for purposes other than cutting documents, for example to count documents. For example, a counting cell can be provided, in the portion of the machine situated toward the downstream end, for example beyond the cutter device 20. Note that any such counting device, which can take the form of a photo-electric cell and an appropriate electronic circuit for counting pulses received from the cell, is known in itself and is therefore not described in more detail.

Although the invention has been described with respect to particular illustrative embodiments thereof, it will be understood by those skilled in the art that the foregoing and various other changes, omissions and deviations in the form and detail thereof may be made without departing from the scope of this invention.

What is claimed is:

1. A document processing machine comprising:

a table for routing documents in a longitudinal direction, a longitudinal document guide wall disposed on one side of the table, a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position, and further comprising, a single drive system for simultaneously driving the movement of the wall and the movement of said at least one drive member.

2. The machine according to claim 1, wherein:

the document routing table includes document routing means adapted to route documents toward the downstream end of the machine along the longitudinal wall when the wall is in a cutting position, said at least one driving member then being in its rest position.

3. A document processing machine comprising:

a table for routing documents in a longitudinal direction, a longitudinal document guide wall disposed on one side of the table, a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position, and further comprising, a drive shaft connected to the wall and that is adapted to be driven in rotation about its shaft, the shaft being provided with a contact member that cooperates with a cam fastened to the wall during movement in rotation of the shaft in order to move the wall.

4. The machine according to claim 3, wherein:

the contact member is provided at one end of the shaft and said shaft has at its opposite end a toothed pulley for driving the shaft in rotation.

5. The machine according to claim 4, further comprising:

a connecting member that runs around the toothed pulley and a second toothed pulley in order to link the rotation movements of the two pulleys to each other.

6. A document processing machine comprising:

a table for routing documents in a longitudinal direction, a longitudinal document guide wall disposed on one side of the table, a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position, and said at least one drive member is adapted to effect a pivoting movement between a retracted rest position and a deployed driving position.

7. The machine according to claim 6, wherein:

said at least one drive member is mounted to pivot about a first reference shaft, the pivoting being driven by the movement of a drive shaft connected to said at least one drive member and which extends relative thereto parallel to the first reference shaft.

8. The machine according to claim 7, wherein:

said at least one drive member is connected to the first reference shaft by a connecting part pivotally mounted on said first reference shaft, the drive shaft being attached to the connecting part.

9. The machine according to claim 8, wherein:

the drive means are in part mounted on the connecting part.

10. The machine according to claim 7, wherein:

the drive shaft cooperates with a mobile cam movement whereof drives movement of said drive shaft.

11. The machine according to claim 10, wherein:

the cam is mounted to rotate about a second reference shaft attached to the machine.

12. The machine according to claim 10, wherein:

the cam has two opposite faces, including a first or internal face provided with a cam surface for cooperation with the drive shaft of said at least one drive member and an opposite second or external face that is provided with a drive member for driving movement of the cam.

13. The machine according to claim 10, wherein:

the cam carries a manual control knob for moving it.

14. The machine according to claim 10, wherein:

the cam includes a toothed pulley.

15. The machine according to claim 7, wherein:

a rotation drive means for driving said at least one drive member is partly mounted on the first reference shaft.

16. A document processing machine comprising:

a table for routing documents in a longitudinal direction, a longitudinal document guide wall disposed on one side of the table, a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position, and said at least one drive member is driven in rotation by a drive means.

17. A document processing machine comprising:

a table for routing documents in a longitudinal direction, a longitudinal document guide wall disposed on one side of the table, a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position, and further comprising, elastic means that couple said at least one drive member to an at least one mobile drive member so that, in the driving position of the least one drive member, said spring means exert an elastic force tending to hold said at least one drive member in that position.

18. A document processing machine comprising:

a table for routing documents in a longitudinal direction, a longitudinal document guide wall disposed on one side of the table, a device for cutting off a portion of a document, the device being arranged downstream of the wall, the wall being movable laterally relative to the cutter device into a plurality of lateral or cutting positions in order to obtain a plurality of cutting widths according to the position of the wall, wherein the machine includes at least one drive member mobile between a rest position and a driving position, the change from the rest position to the driving position being effected while laterally moving the wall from a cutting position to a non-cutting position in which a document routed on the table does not enter the cutter device, said at least one drive member being adapted, in its driving position, to drive a document in the downstream direction when the cutter device is in the non-cutting position, and further comprising, an additional drive member that is arranged in a fixed position above said at least one mobile drive member and is adapted to cooperate therewith to pinch a document between said drive members when said at least one drive member is in its driving position.

* * * * *